US007784278B2

(12) United States Patent
Jacobs et al.

(10) Patent No.: US 7,784,278 B2
(45) Date of Patent: Aug. 31, 2010

(54) HYDRAULIC DRIVE

(75) Inventors: Georg Jacobs, Ulm (DE); Johannes Honnef, Ulm (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 345 days.

(21) Appl. No.: 11/793,568

(22) PCT Filed: Dec. 13, 2005

(86) PCT No.: PCT/EP2005/013388

§ 371 (c)(1),
(2), (4) Date: Jul. 31, 2007

(87) PCT Pub. No.: WO2006/066760

PCT Pub. Date: Jun. 29, 2006

(65) Prior Publication Data

US 2008/0072589 A1 Mar. 27, 2008

(30) Foreign Application Priority Data

Dec. 21, 2004 (DE) ..... 10 2004 061 559

(51) Int. Cl.
*F16B 31/02* (2006.01)

(52) U.S. Cl. ..... 60/475; 60/476

(58) Field of Classification Search ..... 60/476, 60/475

See application file for complete search history.

(56) References Cited

U.S. PATENT DOCUMENTS

2003/0188530 A1 10/2003 Inoue et al.

FOREIGN PATENT DOCUMENTS

| | | |
|---|---|---|
| CA | 605046 | 9/1960 |
| DE | 40 08 792 A1 | 9/1991 |
| DE | 100 13 194 A1 | 9/2001 |
| DE | 103 43 016 A1 | 5/2005 |
| EP | 1 288 505 A1 | 5/2003 |
| JP | 01-280132 | 11/1989 |

*Primary Examiner*—F. Daniel Lopez
(74) *Attorney, Agent, or Firm*—Scully, Scott, Murphy & Presser, P.C.

(57) ABSTRACT

The invention relates to a hydraulic drive, comprising a hydraulic cylinder (1), divided into a first operating pressure chamber (4) and a second operating pressure chamber (5), by an operating piston (3). The hydraulic drive further comprises a closed hydraulic circuit (39), with a first hydraulic pump (43), connected to the first operating pressure chamber (4) via a first working line (7), by means of a first connector (10) and to the second operating pressure chamber (5) via a second working line (13), by means of a second connector (12). In addition, an open hydraulic circuit (40) is provided, with a second hydraulic pump (8), connected to the first operating pressure chamber (4), by means of a third connector (11). A fourth connector (14) on the second hydraulic pump (8) is connected to a hydraulic reservoir element (75).

11 Claims, 2 Drawing Sheets

HYDRAULIC DRIVE

Figure 1:
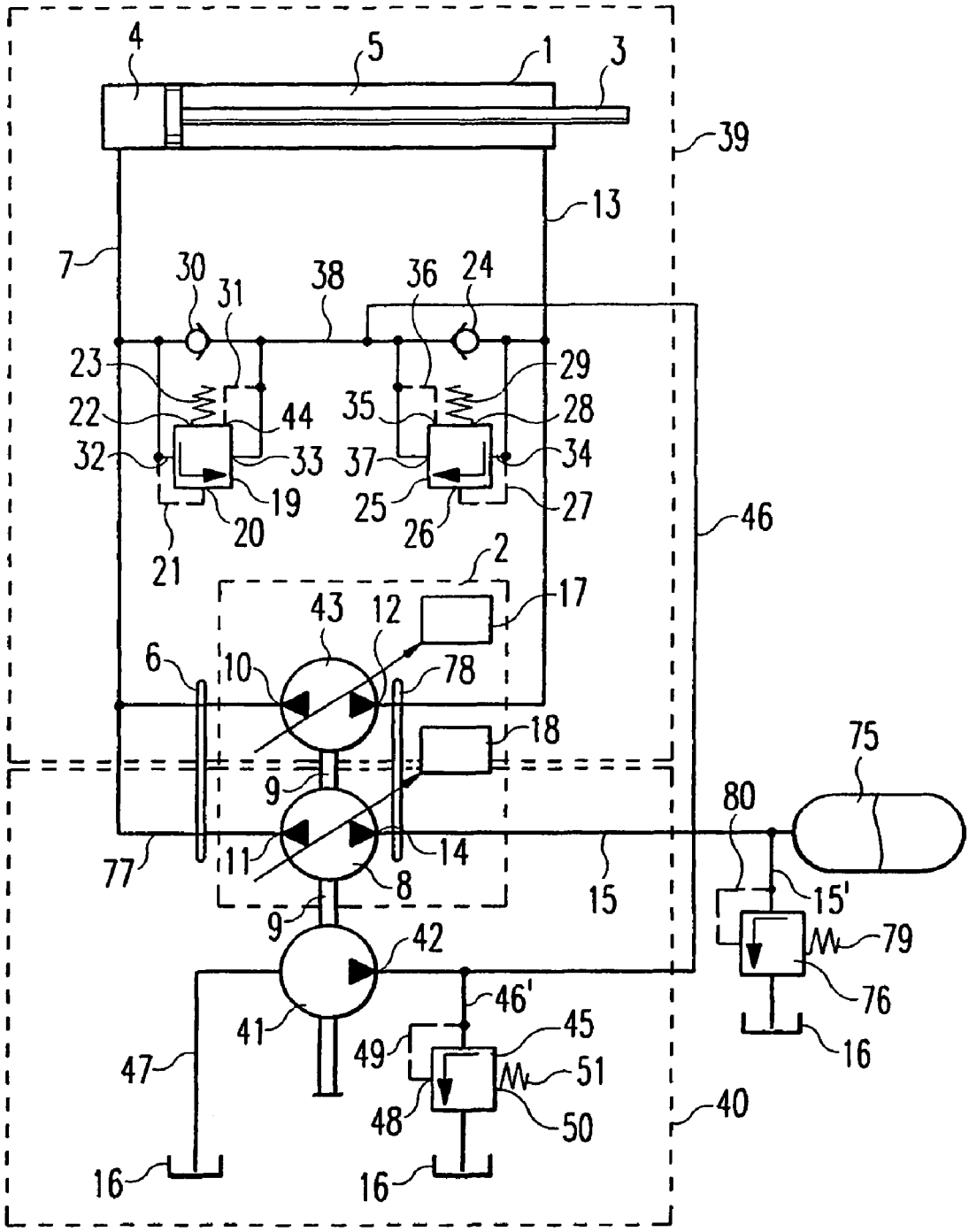

The invention relates to a hydraulic drive with a hydraulic cylinder.

The movement of extension arms or shovels, for example, in mobile operational equipment, is generally implemented hydraulically. As a rule, hydraulic cylinders, which provide a piston capable of being charged with a hydraulic pressure at both ends, are used for this purpose. In order to transfer the movement, for example, to an extension arm, a piston rod is attached to one side of the piston. Because of this piston rod, the changes of volume during a movement of the regulating piston are different on both sides of the regulating piston. The pumping of pressure medium into and respectively out of the corresponding regulating-piston chambers must therefore be adapted accordingly for the regulating-pressure chambers formed on both sides of the regulating piston.

It is already known from DE 40 08 792 A1 that a combination of a closed circuit and an open circuit can be used for this purpose. The regulating-pressure chambers at both sides of the regulating piston are connected in a closed circuit via a hydro-pump, which can be adjusted in its pumping volume. In particular, the connection end of a similarly-adjustable, second hydro-pump is connected to the piston-side regulating-pressure chamber. The second end of the second hydro-pump is connected via a vacuum line to a tank volume. Corresponding to the movement of the regulating piston within the double-action hydraulic cylinder, the differential volume is pumped either into or out of the corresponding regulating-pressure chamber by the second hydro-pump disposed in the open circuit.

The pressure medium to be pumped away is disposed under pressure because the regulating piston of a hydraulic cylinder of this kind is generally hydraulically restrained. This pressure must be relieved, since the pumping of the differential volume in one direction of movement via the second hydro-pump is implemented into the tank volume. This un-used, released energy cannot then be recovered in the event of a reversal of the direction of movement. On the contrary, the pressure medium disposed at the pressure level of the tank volume must be brought to the pressure predominating in the regulating-pressure chamber through an input of work.

The system described therefore has the disadvantage that released energy remains un-used and, in the event of a reversal of movement, the corresponding energy must be generated by the hydro-pump. This leads to an unnecessary waste of energy.

The object of the invention is therefore to provide a hydraulic drive, in which the energy released in one direction of movement is stored and can be released again in the event of a subsequent reversal of the direction of movement.

The object is achieved by the hydraulic drive according to claim 1.

In the case of the hydraulic drive according to claim 1, a first regulating-pressure chamber and a second regulating-pressure chamber of the hydraulic cylinder are connected via a first operating line and a second operating line to a first connection of an adjustable hydro-pump and to a second connection of the adjustable, first hydro-pump. Together with the hydraulic cylinder and the operating lines, the first hydro-pump therefore forms a closed hydraulic circuit.

Additionally, a third connection of a second hydro-pump is connected to the first regulating-pressure chamber of the hydraulic cylinder, which therefore forms an additional open circuit. The fourth connection of the second hydro-pump is connected to a hydraulic accumulator. Accordingly, the pressure medium can be pumped out of the hydraulic accumulator or respectively into the accumulator, which pressure medium must be pumped, because of the different changes in volume in the first and second regulating-pressure chamber of the hydraulic cylinder, either out of the closed circuit or respectively back into the closed-circuit. With a pumping of pressure medium into the hydraulic accumulator, energy can therefore be stored, which can then be used in the event of a reversal of the direction of movement of the regulating piston in the hydraulic cylinder.

Advantageous further developments of the hydraulic drive according to the invention are presented in the dependent claims.

A hydraulic drive according to the invention can be realised in a particularly simple manner, if the pumping volume of the first hydro-pump can be adjusted jointly with that of the second hydro-pump. As a result, the cost-intensive, individual control of the two hydro-pumps is not required. A further simplification is achieved if a double-hydro-pump is used instead of two separate hydro-pumps. In this case, the closed circuit and the open circuit are realised with only a single piston mechanism, which, with its total of four connections, supplies both the closed and also the open circuit.

In order to store high energies, it is particularly advantageous to provide the hydraulic accumulator as a hydro-membrane accumulator. With the use of a hydro-membrane accumulator, the storable hydrostatic energies are particularly high. Dependent upon the use of the respective drive, it may be particularly advantageous to provide the hydro-membrane accumulator as a high-pressure accumulator. However, if such high specifications for the stored pressures are not required, a more cost-favourable, low-pressure accumulator can be used. The use of a low-pressure accumulator has the further advantage that the peripheral structural elements, such as an accumulator-pressure-limiting valve, only need to be designed for relatively low pressures.

It is particularly advantageous to provide a further pump as an auxiliary pump, so that the function of the first and second hydro-pump or respectively of the double-hydro-pump must be adapted exclusively for the lifting, lowering or a corresponding movement of the extension arm or shovel. By contrast, the pumping of unavoidable leakage oil is implemented via an auxiliary pump, which also brings the system up to a given starting pressure at system start-up independently of the first or second hydro-pump. Especially in view of the storage of energy, this de-coupling is particularly advantageous, because the fourth connection of the second hydro-pump must be connected exclusively to the accumulator and to the accumulator-pressure-limiting valve. Further valves or devices, which lead to an energy loss, for example, by leakage, are therefore not required in the region of the energy store.

Figure 2:
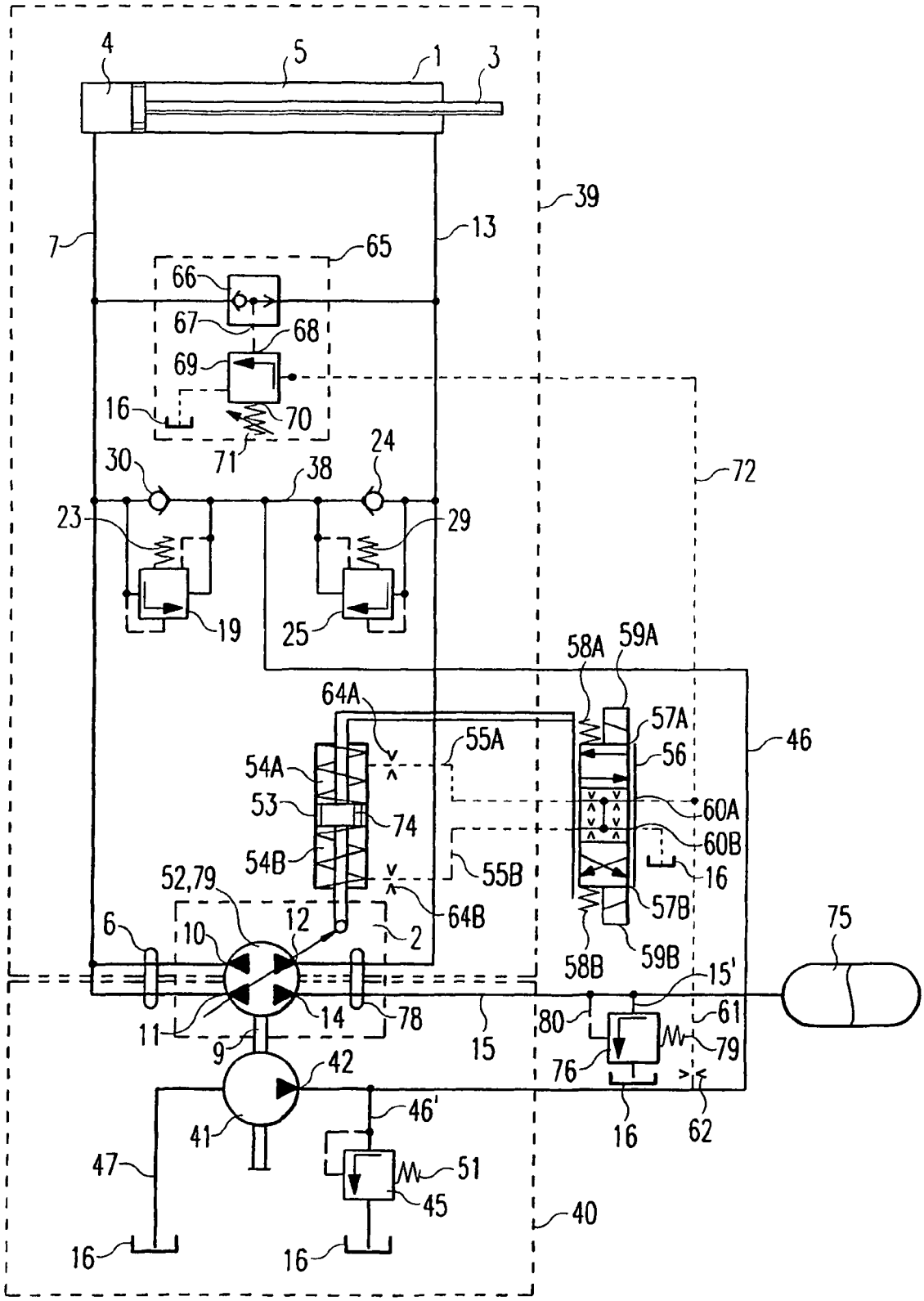

Preferred embodiments of the invention are presented in the drawings and will be described in greater detail below. The drawings are as follows:

FIG. 1 shows a circuit diagram of a first embodiment of the hydraulic drive according to the invention; and FIG. 2 shows a circuit diagram of a second embodiment of the hydraulic drive according to the invention.

A first embodiment of the hydraulic drive according to the invention in an operational unit is described below with reference to FIG. 1.

FIG. 1 shows a circuit diagram of a hydraulic drive according to the invention, which provides a hydraulic cylinder 1 and a hydro-pump element 2, in an operational unit. A regulating piston 3, which divides the hydraulic cylinder 1 into a piston-side, first regulating-pressure chamber 4 and a piston-rod-side, second regulating-pressure chamber 5, is mounted in a displaceable manner within the hydraulic cylinder 1. The first connection end 6 of the hydro-pump unit 2 is connected via a first operating line 7 to the first regulating-pressure chamber 4 of the hydraulic cylinder 1. The hydro-pump unit 2 consists of a first hydro-pump 43 and a second hydro-pump 8, which are connected to one another mechanically via a shaft 9.

The first connection end 6 of the hydro-pump unit 2 is composed of the first connection 10 of the first hydro-pump 43 and the third connection 11 of the second hydro-pump 8. The second connection 12 of the first hydro-pump 43 is connected via the second operating line 13 to the second regulating-pressure chamber 5 of the hydraulic cylinder 1. The fourth connection 14 of the second hydro-pump 8 is connected via a hydraulic line 15 to a hydraulic accumulator 75. The second connection 12 and the fourth connection 14 together form the second connection end 78 of the hydro-pump unit 2. The first hydro-pump 43 can be controlled with regard to its flow of hydraulic fluid via a first pump-control device 17. By analogy, the second hydro-pump 8 can be controlled with regard to its hydraulic fluid flow via a second pump-control device 18. The two pump-control devices 17 and 18 can be controlled optionally either mechanically, hydraulically, pneumatically or electrically.

In the event of an excess pressure in the first operating line 7, a first pressure-limiting valve 19 connected to the first operating line 7 at its input 32 opens. The pressure in the first operating line 7 is applied to a first control connection 20 of the first pressure-limiting valve 19 via a hydraulic connecting line 21. The pressure of an adjustment spring 23, with which the permissible maximum pressure in the first operating line 7 can be adjusted, is applied at the point of engagement 22 of the first pressure-limiting valve 19 with the first control connection 20. In the same direction of action as the force of the adjustment spring 23, the pressure at the output 33 of the first pressure-limiting valve 19 is active on the second control connection 44, which is connected via a hydraulic connecting line 31 to the output 33 of the first pressure-limiting valve 19. In the event of an excess pressure in the operating line 7, the first pressure-limiting valve 19 is opened, if the pressure difference between the input 32 and the output 33 of the first pressure-limiting valve 19 is greater than the maximum pressure difference set by the adjustment spring 23. With an open first pressure-limiting valve 19, an excess pressure in the first operating line 7 is released into the second operating line 13 via a first non-return valve 24, which is connected between the first pressure-limiting valve 19 and the second operating line 13 in a line 38 connecting the first and second operating line 7 and 13.

By analogy, in the event of an excess pressure in the second operating line 13, a second pressure-limiting valve 25 connected at its input 34 to the second operating line 13, which is connected in parallel to the first non-return valve 24, opens. The pressure in the second operating line 13 is applied to the first control connection 26 of the second pressure-limiting valve 25 via a hydraulic connecting line 27. The pressure of an adjustment spring 29, with which the permissible maximum pressure in the second operating line 13 can be adjusted, is applied to the point of engagement 28 of the second pressure-limiting valve 25. In the same direction of action as the pressure of the adjustment spring 29, the pressure at the output 37 of the second pressure-limiting valve 25 is active on the second control connection 35 of the second pressure-limiting valve 25, which is connected via a hydraulic connecting line 36 to the output 37 of the second pressure-limiting valve 25. In the event of an excess pressure in the second operating line 13, the second pressure-limiting valve 25 is opened, if the pressure difference between the input 34 and the output 37 of the second pressure-limiting valve 25 is greater than the maximum pressure difference set by the adjustment spring 29. With an open second pressure-limiting valve 25, the excess pressure in the second operating line 13 is released into the first operating line 7 via a second non-return valve 30, which is disposed between the second pressure-limiting valve 25 and the first operating line 7 and parallel to the first pressure-limiting valve 19 in the line 38.

Together with the hydraulic cylinder 1, the first hydraulic line 7 and the second hydraulic line 13, the first hydro-pump 43 forms a closed hydraulic circuit 39. The second hydro-pump 8 supplies the piston-side, first regulating-pressure chamber 4 of the hydraulic cylinder 1 via an open circuit 40. For this purpose, the second connection 11 of the second hydro-pump 8 is connected via an operating-line branch 77 to the first operating line 7 and accordingly to the first regulating-pressure chamber 4.

The regulating piston 3 is moved and positioned within the hydraulic cylinder 1 corresponding to the required position and direction of movement of the kinematics of the operational unit driven by the hydraulic drive. In order to move and position the regulating piston 3 within the hydraulic cylinder 1, a corresponding quantity of hydraulic fluid is pumped by the hydro-pump unit 2 via a pump-flow control unit into the first and second regulating-pressure chamber 4 and 5 of the hydraulic cylinder 1. The volume changes caused in the first regulating-pressure chamber 4 or respectively the second regulating-pressure chamber 5 in the event of a movement of the regulating piston are different, because the regulating piston 3 provides a regulating-piston rod on one side. The regulating movement is substantially caused by the first hydro-pump 43, which, in the event of a movement of the regulating piston 3 within the closed circuit towards the right as shown in FIG. 1, pumps pressure medium out from the second regulating-pressure chamber 5 via the second operating line 13 and the first operating line 7 and into the first regulating-pressure chamber 4. In order to balance the different change in volume in the two regulating-pressure chambers 4 and 5, the pressure medium additionally required in the first regulating-pressure chamber 4 is supplied to the first regulating-pressure chamber 4 via the open circuit 40. In addition to the pressure medium pumped by the first hydro-pump 43 from the second regulating-pressure chamber 5 into the first regulating-pressure chamber 4, pressure medium is pumped via the operating line branch 77 through the second hydro-pump 8 into the first regulating-pressure chamber 4.

For this purpose, the second-hydro-pump 8 pumps pressure medium, which is stored in a hydraulic accumulator 75, via the hydraulic line 15.

The hydraulic accumulator 75 is filled by a movement opposite to the direction of movement described above. If the regulating piston 3 moves towards the left as shown in FIG. 1, more pressure medium must be pumped by the first hydro-pump 43 out of the first regulating-pressure chamber 4 than is pumped into the second regulating-pressure chamber 5. The excess pressure medium is pumped by the second hydro-pump 8 and the hydraulic line 15 into the hydraulic accumulator 75. The hydraulic accumulator 75 is preferably formed as a hydro-membrane accumulator. When introducing the pressure medium into the hydraulic accumulator 75, a gas volume disposed behind a membrane is compressed, so that the hydraulic accumulator 75 is used not only for the accommodation of the differential pressure medium, but at the same time also represents an energy store. Conversely, the energy stored in the hydraulic accumulator 75 can be used, in the event of a change in the direction of movement of the regulating piston 3, in order to pump the pressure medium disposed in the accumulator 75 back into the first regulating-pressure chamber 4. By way of difference from an open circuit, in which the second hydro-pump 8 is connected to a tank volume, the release of energy, for example, in the case of a lowering of a shovel of a digger, is therefore not converted into heat by the release of the pressure medium through a throttle, but is stored in the membrane accumulator. Accordingly, the stored energy can be used, and pressure medium does not need to be drawn from pressure-free tank volume in order to balance the volume.

The hydraulic accumulator 75 is secured against the occurrence of excessively high accumulator pressures via an accumulator-pressure limiting valve 76. The accumulator-pressure limiting valve 76 is connected at the input end via a hydraulic branch line 15' to the hydraulic line 15. The pressure predominating there acts via a hydraulic connecting line 80 against an adjustment spring 79, with which the opening pressure of the accumulator-pressure-limiting valve 75 can be adjusted. If the threshold value is exceeded, the hydraulic line 15 is relieved into the tank volume 16.

By way of difference from an open system, in which the pressure-medium flow required for volume balancing is pumped from a tank volume and into a tank volume by the second hydro-pump, the pumping of leakage pressure medium via the second hydro-pump 8 is not possible in the case of the embodiment according to the invention. An auxiliary pump 41, also driven by the shaft 9, which draws pressure medium via a vacuum line 47 from a tank volume and pumps it into a feeder line 46, is therefore provided. The auxiliary pump 41 is preferably a constant pump pumping only in one direction. Since the pumping power of a constant pump of this kind is dependent upon the rotational velocity of the shaft 9, the feeder line 46 is secured by a third pressure-limiting valve 45. The third pressure-limiting valve 45 is connected to the feeder line 46 via a feeder-line branch 46'. An adjustment spring 51 impinges upon a point of engagement 50 of the third pressure-limiting valve 45. The pressure predominating in the feeder line 46 and respectively the feeder-line branch 46' acts in the opposite direction on a control input 48 of the third pressure-limiting valve 45 via a hydraulic connecting line 49. If the corresponding hydraulic force at the control input 48 exceeds the force of the opposing adjustment spring 51, the third pressure-limiting valve 45 opens and releases a through-flow connection between the feeder line 46 and the tank volume 16.

The feeder line 46 opens at its end facing away from the auxiliary pump 41 into the line 38, so that pressure medium can be fed via the first non-return valve 24 or respectively the second non-return valve 30 into the second operating line 13 or respectively the first operating line 7, provided a lower pressure predominates in the respective operating line 7 or 13 than in the feeder line 46.

FIG. 2 shows a second embodiment of the hydraulic drive according to the invention of an operational unit.

The hydro-pump unit 2 of the second embodiment shown in FIG. 2 is realised by a double hydro-pump 52, which supplies two hydraulic circuits, the closed hydraulic circuit 39 via the first connection 10 and the second connection 12, and the open hydraulic circuit 40 via the third connection 11 and the fourth connection 14. A flow-dividing axial piston pump 79, which is adjusted via a common pump-control device 53, is preferably used in this context.

The regulating-pressures for a first and a second pump-regulating-pressure chamber 54A and 54B of a pump-control device 53 are supplied via hydraulic lines 55A and 55B, into which hydraulic throttles 64A and 64B can be inserted in order to limit the pump flow, and adjusted in an adjustment valve 56, which is designed as a 4/3-way valve. The control force of the adjustment valve 56 is generated at a first control input 57A by an adjustment spring 58A and an electrically-controllable electromagnet 59A and at a second control input 57B by an adjustment spring 58B and an electrically-controllable electromagnet 59B. An input 60A of the adjustment valve 56 is connected to the feeder connection 42 of the auxiliary pump 41 via a hydraulic connecting line 61, in which a hydraulic throttle 62 is inserted in order to limit the pump flow. An output 60B of the adjustment valve 56 is connected to the tank volume 16. Dependent upon the electrical control of the two electromagnets 59A and 59B at the first and second control input 57A and 57B, the first pump-regulating-pressure chamber 54A is connected to the regulating-pressure, and the second pump-regulating-pressure chamber 54B is connected to the tank volume 16 or vice versa. The pressure between the first and the second pump-regulating-pressure chamber 54A and 54B is balanced in a resting position of the adjustment valve 56 defined by the adjustment springs 58A and 58B.

A pressure cut-off valve 65 is provided preferably between the first operating line 7 and the second operating line 13 in order to avoid any loss of hydraulic power enduring longer than necessary of the hydraulic drive according to the invention in an end position of the regulating piston 3 within the hydraulic cylinder 1 as a result of the release of excess pressure via the first or second pressure-limiting valve 19 or 25. This pressure cut-off valve 65 comprises a pressure-shuttle valve 66, which is connected between the first operating line 7 and the second operating line 13. In the event of an excess pressure in the first operating line 7 or in the second operating line 13 because of an end position of the regulating piston 3 within the hydraulic cylinder 1, the excess pressure is connected to the output 67 of the pressure-shuttle valve 66. The output 67 of the pressure-shuttle valve 66 is connected to the control input 68 of a fourth pressure-limiting valve 69. If the pressure at the control input 68 of the fourth pressure-limiting valve 69 is higher, because of an excess pressure in the first operating line 7 or in the second operating line 13, than a maximum pressure adjustable by means of an adjustment spring 71 at the point of engagement 70 of the fourth pressure-limiting valve 69, the fourth pressure-limiting valve 69 opens. In this manner, the input 60A of the adjustment valve 56 is connected to the tank volume via the hydraulic connecting line 72, which is connected to the input of the fourth pressure-limiting valve 69.

This reduces the regulating-pressure for the pump-control device 53 at the input 60A of the adjustment valve 56, and the regulating piston 74 of the pump-control device 53 is displaced in the direction towards the resting position. As a result, the pump-flow volume of the double hydro-pump 52 is controlled back, and the excess pressure in the first operating line 7 or in the second operating line 13 declines. Upon reaching a given pressure in the first operating line 7 or in the second operating line 13, the pressure-shuttle valve 66 closes again and therefore terminates the reduction of the regulating-pressure for the pump-control device 53.

The storage of energy and its recovery by means of the hydraulic accumulator 75 corresponds to the method as described with reference to FIG. 1.

The invention is not restricted to the embodiment presented. In particular, all of the features of all embodiments can advantageously be combined with one another.

The presentations of the exemplary embodiments describe the invention in a simplified manner. In particular, further features for the improvement of the hydraulic drive are conceivable within the circuit of the auxiliary pump 41. For example, it is possible to arrange a filter for cleaning the hydraulic fluid throughout the entire system at the vacuum side of the auxiliary pump. Moreover, the release of pressure to the tank volume via the third pressure-limiting valve can be implemented via a cooler.

The hydraulic accumulator can be designed either as a low-pressure accumulator or as a high-pressure accumulator. Dependent upon the energy to be stored, the use of a low-pressure accumulator can be particularly advantageous. For instance, the pressure in the hydraulic line 15 can be kept low through the use of a low-pressure accumulator. This leads to a corresponding design of the accumulator-pressure limiting valve 76. Furthermore, with regard to the second hydro-pump 8, the pressure medium need not be pumped at a high pressure level along the hydraulic line 15 to the hydraulic accumulator 75.

Conversely, a larger quantity of energy can be stored in a high-pressure accumulator because of the higher realisable pressures. In both cases, losses are reduced because the auxiliary pump 41 for the feeding of pumped pressure medium pumps directly into the first operating line 7 or the second operating line 13 via the feeder line 46. A cost-intensive combination with the accumulator system for the storage of hydraulic energy in the accumulator is not therefore required. The connecting line 15 is therefore used exclusively for filling the hydraulic accumulator 75 with pressure medium or respectively for the removal of the pressure medium stored there.

The invention claimed is:

1. Hydraulic drive, with a hydraulic cylinder, which is divided by a regulating piston into a first regulating-pressure chamber and a second regulating-pressure chamber, and with a closed hydraulic circuit, which comprises a first hydro-pump, which is connected by a first connection via a first operating line to the first regulating-pressure chamber and which is connected by a second connection via a second operating line to the second regulating-pressure chamber, and with an open hydraulic circuit, which comprises a second hydro-pump, which is connected by a third connection to the first regulating-pressure chamber, wherein a fourth connection of the second hydro-pump is connected to a hydraulic accumulator via a connecting line, wherein the hydraulic accumulator stores energy and the pressure medium is filled into the hydraulic accumulator exclusively by the second hydro-pump and is removed from the hydraulic accumulator exclusively by the second hydro-pump; and wherein an auxiliary pump, which is connected to the first operating line and to the second operating line for the supply of pressure medium, in provided an addition to the first hydro-pump and the second hydro-pump.

2. Hydraulic drive according to claim 1, wherein the pumping volume of the first hydro-pump and the second hydro-pump are jointly adjustable.

3. Hydraulic drive according to claim 1, wherein the first hydro-pump and the second hydro-pump are formed as a double hydro-pump.

4. Hydraulic drive according to claim 1, wherein the hydraulic accumulator is a hydro-membrane accumulator.

5. Hydraulic drive according to claim 1, wherein the hydraulic accumulator is a high-pressure accumulator.

6. Hydraulic drive, including a hydraulic cylinder, which is divided by a regulating piston into a first regulating-pressure chamber and a second regulating-pressure chamber, and with a closed hydraulic circuit, which comprises a first hydro-pump which is connected by a first connection via a first operating line to the first regulating-pressure chamber and which is connected by a second connection via a second operating line to the second regulating-pressure chamber; and with an open hydraulic circuit, which comprises a second hydro-pump, which is connected by a third connection to the first regulating-pressure chamber, wherein a fourth connection of the second hydro-pump is connected to a hydraulic accumulator via a connecting line which is not connected to a non-return valve connected to the first or second operating line, wherein the hydraulic accumulator is used for storing energy and the pressure medium in the hydraulic accumulator is filled into the hydraulic accumulator exclusively by the second hydro-pump and pressure medium is removed from the hydraulic accumulator exclusively by the second hydro-pump.

7. Hydraulic drive according to claim 6, wherein the pumping volume of the first hydro-pump and the second hydro-pump are jointly adjustable.

8. Hydraulic drive according to claim 6, wherein the first hydro-pump and the second hydro-pump are formed as a double hydro-pump.

9. Hydraulic drive according to claim 6, wherein the hydraulic accumulator is a hydro-membrane accumulator.

10. Hydraulic drive according to claim 6, wherein the hydraulic accumulator is a high-pressure accumulator.

11. Hydraulic drive according to claim 6, wherein an auxiliary pump, which is connected to the first operating line and to the second operating line for the supply of pressure medium is provided in addition to the first hydro-pump and the second hydro-pump.

* * * * *